US007578720B2

(12) United States Patent
Drosendahl et al.

(10) Patent No.: US 7,578,720 B2
(45) Date of Patent: Aug. 25, 2009

(54) ACTIVITY DEVICE

(75) Inventors: Christine A. Drosendahl, Bristol, RI (US); Albert P. Maggiore, Lancaster, NY (US)

(73) Assignee: Mattel, Inc., El Segundo, CA (US)

( * ) Notice: Subject to any disclaimer, the term of this patent is extended or adjusted under 35 U.S.C. 154(b) by 668 days.

(21) Appl. No.: 10/976,305

(22) Filed: Oct. 29, 2004

(65) Prior Publication Data

US 2006/0094328 A1 May 4, 2006

(51) Int. Cl.
*A63H 33/00* (2006.01)

(52) U.S. Cl. ..... 446/227; 446/267

(58) Field of Classification Search ..... 446/227, 446/267; 40/406–414
See application file for complete search history.

(56) References Cited

U.S. PATENT DOCUMENTS

| | | | | |
|---|---|---|---|---|
| 4,428,305 | A | 1/1984 | Creske | |
| 4,643,692 | A * | 2/1987 | Magers | 446/259 |
| 5,010,461 | A | 4/1991 | Saotome | |
| D323,263 | S | 1/1992 | Blackburn | |
| 5,110,636 | A * | 5/1992 | Hou | 40/410 |
| 5,160,288 | A | 11/1992 | Seda | |
| 5,254,007 | A | 10/1993 | Eagan | |
| 5,269,717 | A | 12/1993 | Tardif | |
| D358,421 | S | 5/1995 | Chow et al. | |
| 5,442,869 | A * | 8/1995 | McDarren et al. | 40/406 |
| 5,456,031 | A * | 10/1995 | Hou | 40/410 |
| D368,931 | S | 4/1996 | Ling | |
| 5,732,999 | A | 3/1998 | Petrie | |
| 5,816,171 | A | 10/1998 | Fitts, Jr. | |
| 5,823,329 | A | 10/1998 | Roberts | |
| 5,921,841 | A * | 7/1999 | Coleman et al. | 446/267 |
| 6,000,761 | A | 12/1999 | Rocha | |
| 6,077,144 | A * | 6/2000 | Fishman | 446/236 |
| 6,080,067 | A * | 6/2000 | Leff | 472/63 |
| 6,095,885 | A * | 8/2000 | Coleman et al. | 446/236 |
| 6,352,168 | B1 | 3/2002 | Lin | |
| D463,923 | S * | 10/2002 | Wistehuff, Sr. | D6/480 |
| 6,463,257 | B1 | 10/2002 | Wood | |
| 6,464,078 | B1 | 10/2002 | Grossnickle | |

(Continued)

OTHER PUBLICATIONS

Fisher-Price Play Zone Music Table, http://www.amazon.com/exec/obidos/tg/detail/-/B00006HBTI/qid=1069444431/sr=1-32/ref=sr_1_32/104-4531104-4095111?v, Nov. 21, 2003.

(Continued)

*Primary Examiner*—Gene Kim
*Assistant Examiner*—Urszula M Cegielnik
(74) *Attorney, Agent, or Firm*—Edell, Shapiro & Finnan, LLC

(57) ABSTRACT

An activity device includes a housing, at least one interactive feature, and a rotatable container mounted on the housing. The container, which is capable receiving accessories, includes an outer wall and an inner wall that define a cavity therebetween. At least one of the inner or outer walls may be transparent. The cavity is configured to hold a fluid with objects dispersed therein. The rotation of the container about its axis causes agitation of the liquid medium and engages an actuator coupled to a control unit. The control unit, when actuated via the rotation of the container, generates sensory stimulating output.

48 Claims, 9 Drawing Sheets

U.S. PATENT DOCUMENTS

| | | | | |
|---|---|---|---|---|
| 6,595,780 | B2 | 7/2003 | Singh et al. | |
| 2002/0096528 | A1 | 7/2002 | Fernandez | |
| 2003/0129572 | A1 | 7/2003 | Shuler et al. | |
| 2003/0196357 | A1 * | 10/2003 | Knapp et al. | 40/410 |
| 2004/0244243 | A1 * | 12/2004 | Tien | 40/410 |

OTHER PUBLICATIONS

Fisher-Price Brilliant Basics™ Musical Pop-tivity Table http://www.fisher-price.com/us/infanttoys/product.asp?s=bubrilliant &id=27498, Oct. 27, 2004.

Fisher-Price Photo Fun Learning Smart Screen Intelli-Table™, http://www.fisher-price.com/us/products/product.asp?id=23422, Oct. 27, 2004.

Fisher-Price Bee-Bop Buildin™ Spinning Tunes Activity Table, http://www.fisher-price.com/us/products/product.asp?id=10216, Nov. 24, 2003.

Vtech 2-in-1 Exploration Station, http://www.vtechkids.com/products_smart_start_series/2_in_1_exploration_station.php, Nov. 21, 2003.

Hasbro, Imagination Station Table, http://www.target.com/gp/detail.html/sr=1-9/qid=1069445252/ref=sr_I_9/601-6865492-9921712?asin=B0000959KF, Nov. 21, 2003.

Hasbro, Magic Motion Play Center, http://hasbro.com/pl/page.viewproduct/product_id.9313/dn/default.cfm, Nov. 21, 2003.

Chicco, Modo Flip 'n' Play Table, http://www.chiccousa.com/createXML.asp?pp=ppgio_sc2_00.067120.000.000_USA&m, Nov. 21, 2003.

LeapFrog, LeapStart™ Learning Table, http://www.leapfrog.com/do/findproduct?ageGroupKey=infant&key=learntable, Oct. 27, 2004.

Little Tikes, Glitter Flitter™ Butterfly, http://littletykes.com/toyfinder/ProductsFull.asp?sku=1612&category=5, Oct. 27, 2004.

Creative Motion Industries, Glitter Reflection Lamp, http://www.cmi-co.com/details.asp?product=313, Oct. 27, 2004.

* cited by examiner

ACTIVITY DEVICE

FIELD OF THE INVENTION

The present invention relates to an activity device including an control unit configured to generate sensory stimulating output and, in particular, to an activity device including a rotatable container capable of activating the control unit. The container may further include a fluid filled cavity with objects suspended therein.

BACKGROUND

Children learn through interacting with their environment. Infants and toddlers are often introduced to learning through audio and visual stimulation related to different fields of experience. Educational devices and toys not only provide neurological stimulation, but also can help children develop motor skills. Thus, it would be desirable to provide an electronic toy with interactive features that encourage a child to learn letters, numbers, counting, spelling, etc. In particular, it is desirable to provide an entertainment device including activities with which a child can interact to produce sensory stimulating output, including sound, light, or animation. Such activities not only stimulate the senses and reinforce educational material (teaching cause and effect, ABCs, and 123s), but they also help to develop and refine a child's motor skills.

The present invention is directed generally to an activity device or toy including a rotatable container coupled to an control unit such that, when the container is engaged or manipulated, sensory stimulating output is produced by the electronics assembly. More specifically, the present invention is directed to an activity device or toy including a container having a fluid-filled cavity, wherein the container is coupled to an control unit such that the rotation of the container not only activates the control unit, but also agitates the fluid within the cavity.

SUMMARY

Generally, the embodiments of the present invention provide an activity device or toy and, more particularly, an activity device including a housing and a rotatable container mounted thereon, wherein the rotation of the container engages an actuator that activates the production of sensory stimulating output.

BRIEF DESCRIPTION OF THE DRAWINGS

Like reference numerals have been used to identify like elements throughout this disclosure.

DETAILED DESCRIPTION

In accordance with the present invention, an activity device including a housing and a container rotatably coupled to the housing is disclosed. The container, when rotated, activates a control unit capable of producing sensory stimulating output. The container, furthermore, may be configured to incorporate a fluid housed therein. Furthermore, the fluid housed within the container may include decorative objects suspended therein.

Figure 1:
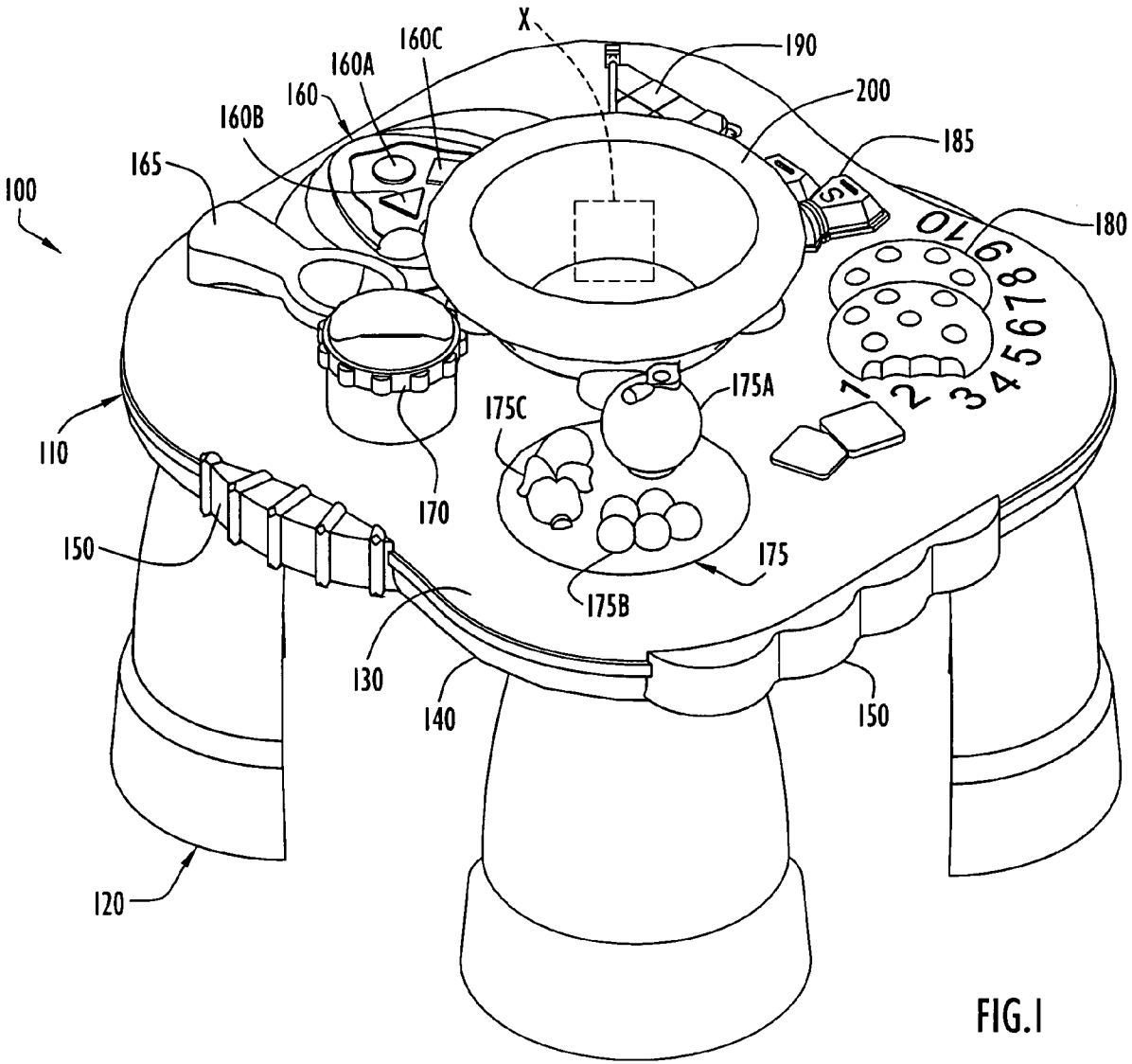
FIG. 1 illustrates a perspective view of an activity device according to an embodiment of the present invention including a rotatable container connected to a housing.

FIG. 1 illustrates a perspective view of an entertainment device according to an embodiment of the present invention including a rotatable container connected to a housing. In the embodiment shown, the activity device 100 includes a housing 110 and a support portion 120. The housing 110 may comprise a structure configured to both house the electronic components of the activity device 100, as well as display the device's interactive features. Specifically, the housing 110 may include a generally hollow structure having an upper section 130 and a lower section 140. The housing 110 is not limited to the structure of FIG. 1, and may be of any appropriate shape or size. The housing 110 may further include one or more handles or grab portions 150 extending transversely from the outer surface of the housing 110 to allow a user to manipulate and carry the activity device 100.

The support portion 120 may include a structure configured to support the housing 110 above a supporting surface. As shown in the embodiment of FIG. 1, the support portion 120 may include at least one leg or post that may removably attach to the lower section 140 of the housing 110. The lower section 140 of the housing 110 may include at least one recess or slot (not shown) configured to receive the leg. The leg may include a depressible tab configured to engage an indentation located along the wall of the slot. Consequently, when a leg is axially inserted into the corresponding slot, the wall of slot depresses the tab until it becomes aligned with the indentation. Once aligned, the tab enters the indentation, becoming captured therein and preventing the leg from being axially removed. The leg may further include a release button capable of retracting the tab from the indentation, permitting the removal of the leg from the slot.

In operation, the activity device 100 may be configured in a sit-down configuration or a stand-up configuration. That is, the activity device 100 may be used with the support portion 120 attached (allowing a child to stand while interacting with the device 100), or may be used without the support portion 120 as a tablet, being set on a floor, a table, or other supporting surface.

The activity device 100 further includes at least one interactive feature mounted on the housing 110. Specifically, as shown in the embodiment of FIG. 1, the housing 110 includes several interactive features. These interactive features may be stylized as everyday household items such as a slice of pizza 160 with push buttons, a removable spoon 165, a pop-up sippy cup 170, a tray of fruit 175 (including, for example, a rotatable apple 175A, slidable berries 175B, and a push-down banana 175C), a pair of cookies with 180 roller balls, a tilting salt and pepper shaker 185, and a pivoting/flipping napkin 190. The interactive features are not limited to those shown in the embodiment of FIG. 1. One or more of the interactive features may be coupled to one or more switches (not shown). Each switch, moreover, may be coupled to a control unit (not shown in FIG. 1) stored within the housing 110. When activated by manipulating the interactive features, the one or more switches may be configured to communicate with the control unit, which, in turn, may produce sensory stimulating output (e.g., animation, lights, or sound). Specifically, when a switch is engaged, the control unit may produce interactive feature-specific or button-specific output.

For example, the slice of pizza interactive feature 160 may include a plurality of actuators stylized as different geometric shapes. By way of specific example, the slice of pizza interactive feature 160 may include three depressible buttons—one stylized as a circle 160A, one stylized as a triangle 160B, and one stylized as a square 160C. Each button 160A, 160B, 160C, when depressed, may be configured to engage a switch coupled to a control unit (discussed below). Similarly, the pop-up sippy cup interactive feature 170 may include an axially depressible container capable of engaging a switch coupled to the control unit. When depressed, the container engages the switch, which, in turn, communicates with the control unit. The control unit may recognize the activation of that particular switch and may generate a switch-specific output.

The tray of fruit interactive feature 175 may include various elements stylized as fruits. As shown, the tray 175 includes an apple element 175A, a berry cluster element 175B, and a banana element 175C. Each element of the tray of fruit interactive feature 175 may be coupled to a switch that, in turn, is coupled to the control unit. The control unit may be configured to recognize when the respective switches are engaged and may generate switch-specific sensory stimulating output. For example, the apple element 175A may be capable of rotating 360° on its axis and configured to, when rotated, engage a switch coupled to the control unit. The berry cluster element 175B, furthermore, may be configured to slide back and forth through a defined path along the top surface of the upper section 130 of the housing 110. As the berry cluster element 175B slides, it may engage a switch coupled to the control unit. Finally, the banana element 175C may be formed from a soft, pliable, material that, when squeezed or depressed, may engage a switch coupled the control unit. The control unit may again be configured to recognize when the respective switches are engaged and may generate switch-specific, sensory stimulating output.

In a like manner, the cookie feature 180 may comprise a depressible housing that, when pressed downward, engages a switch coupled to the control unit. In turn, the control unit recognizes the switch activation and generates switch-specific, sensory stimulating output. The housing of the cookie feature 180 may further include a plurality of recesses with spheres rotatably captured within each recess, allowing a child to spin the spheres within the recesses. The salt and pepper shaker interactive feature 185 may be mounted on the upper section 130 of the housing 110 by its attachment to a vertical post (not shown) such that it is capable of partial rotation or tilting in either a clockwise or counterclockwise direction. The salt and pepper shaker interactive feature 185 may be coupled to a switch that, in turn, is coupled to the control unit. When the salt and pepper shaker interactive feature 185 is partially rotated or tilted in either a clockwise or counterclockwise direction, the switch is engaged. The control unit may be configured to recognize the activation of this switch and generate a switch-specific, sensory stimulating output. Finally, the pivoting/flipping napkin interactive feature 190 may include a napkin-shaped element pivotally mounted to the upper section 130 of the housing 110 on a pivot post. The pivoting/flipping napkin feature 190 may further include a switch coupled to the control unit. Pivoting or flipping the napkin 190 (with respect to the surface of the upper section 130 of the housing 110) engages the switch. The activation of the napkin switch is recognized by the control unit, which may then produce switch-specific, sensory simulating output.

Figure 2:
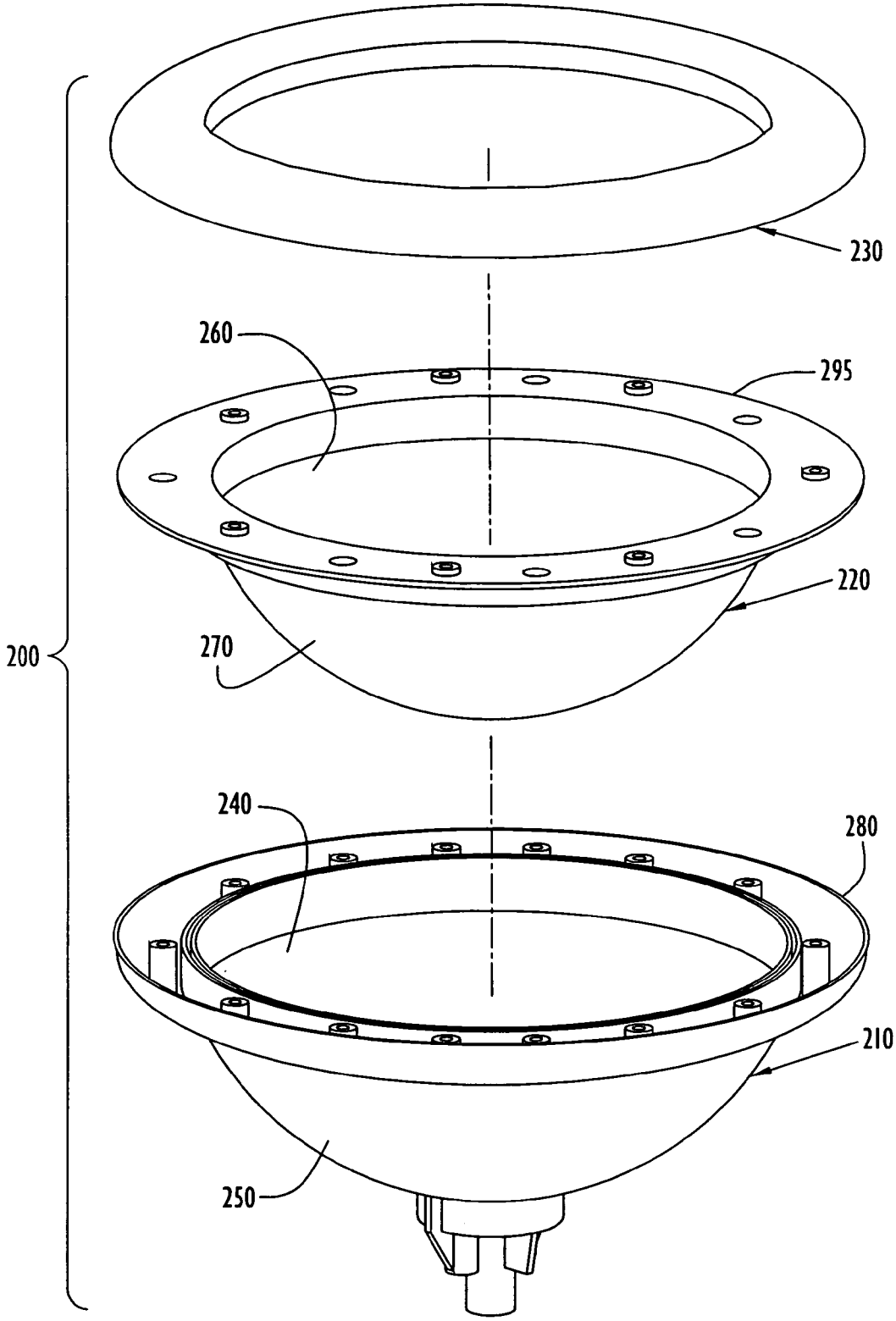
FIG. 2 illustrates an exploded perspective view of the container of the activity device of FIG. 1.

The activity device 100 further includes a container 200 adapted to rotate freely on the housing 110. The container 200 may include a structure operable to support or store one or more accessories (an example of an accessory, a block, is shown at X). For example, the container 200 may include an interior surface and an opening through which an accessory X may be placed onto and removed from the interior surface. FIG. 2 illustrates an exploded perspective view of the container 200 of the activity device 100 according to one embodiment of the present invention. The container 200 may include an outer wall or member 210, an inner wall or member 220, and a cap or cover portion 230. The outer member 210 includes an interior surface 240 and an exterior surface 250. Similarly, the inner member 220 includes an interior surface 260 and an exterior surface 270. The outer and inner members 210, 220 are configured such that the inner member 220 may be coaxially disposed within the outer member 210, with the interior surface 240 of the outer member 210 and the exterior surface 270 of the inner member 220 defining a gap or cavity therebetween. The material comprising one or both of the outer member 210 and the inner member 220 may include, but is not limited to materials, such as plastics, that are transparent, translucent, colored, or opaque.

As shown in the embodiment of FIG. 2, the container 200 may include an outer member 210 and an inner member 220 stylized as bowls having a generally curved shape. However, the container 200 of the present invention is not limited to the embodiment of FIG. 2 and may comprise any size or shape. With the configuration shown in FIG. 2, a user may place and store objects or accessories within the container 200 (i.e., on the interior surface 260 of the inner member 220).

The outer member 210 may further include a flange 280 extending transversely or radially outward from the exterior surface 250 of the outer member 210. Similarly, the inner member 220 may also include a flange 295 extending transversely or radially outward from the exterior surface 270 of the inner member 220. With this configuration, when the inner member 220 is axially inserted into the outer member 210, the flange 295 of the inner member 220 extends over the cavity (defined between interior surface 240 of the outer member 210 and the exterior surface 270 of the inner member 220) and engages the flange 280 of the outer member 210. The outer member flange 280 may connect to the inner member flange 295 to form a fluid tight seal along the flanges 280, 295. For example, the outer and inner members 210, 220 may be secured along their flanges 280, 295 using conventional securing means such as screws, adhesives, thermal welding, chemical welding, etc. The cap 230 may be configured to attach to the flange 295 of the inner member 220. The cap 230 may further include visual indicia such as educational indicia (e.g., letters, numbers, musical notes, etc.) to further stimulate the user of the activity device 100.

Figure 3:
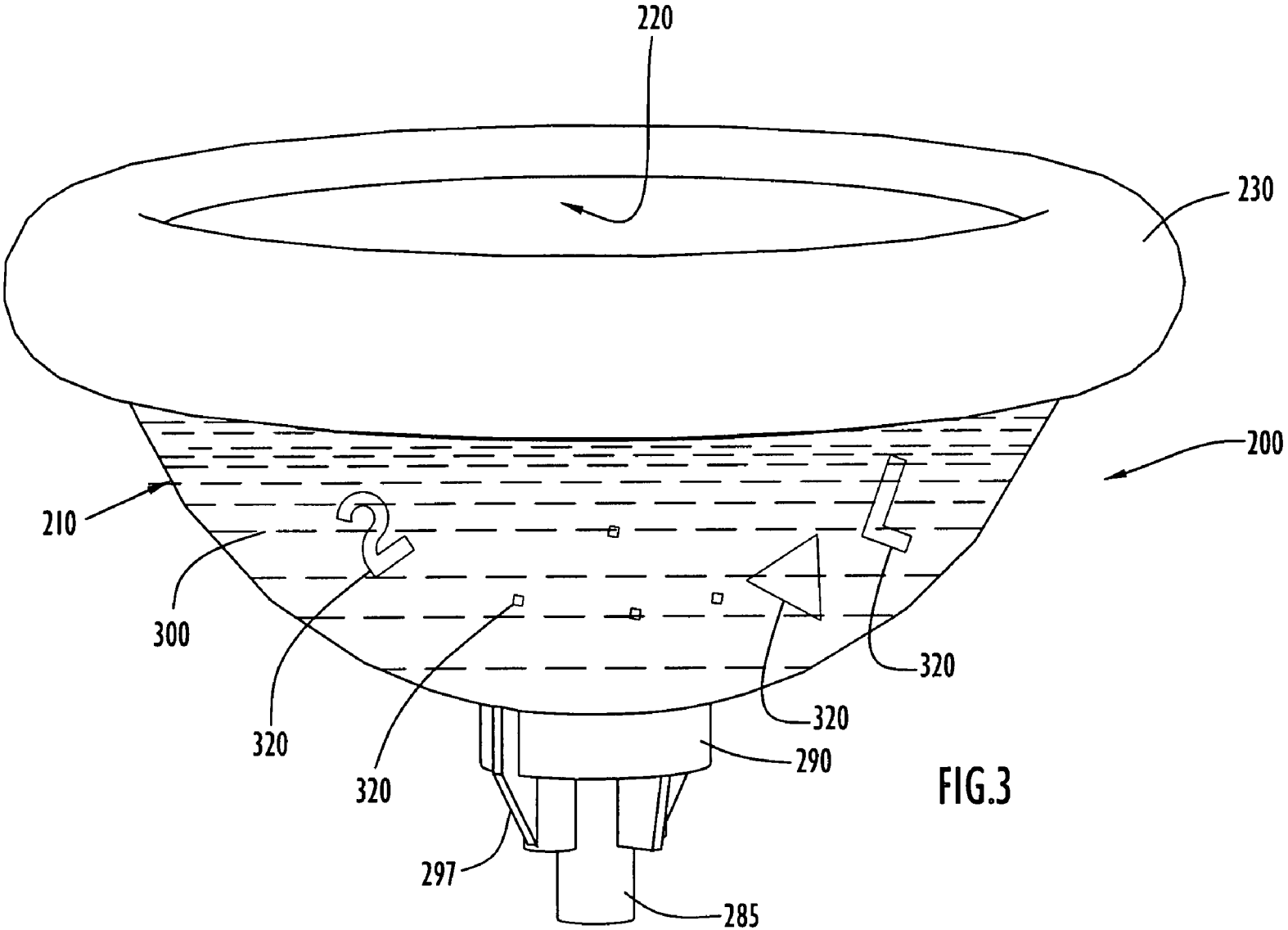
FIG. 3 illustrates an isolated perspective view of the container of the activity device of FIG. 1.

FIG. 3 illustrates an isolated perspective view of the container 200 of the activity device of FIG. 1 according to an embodiment of the invention. As shown, the inner member 220 is concentrically disposed in the outer member 210. The outer member flange 280 and the inner member flange 295 are sized such that the outer member flange 280 it is positioned against the inner member flange 295 (not shown). The dimensions of the inner member 220 are smaller than those of the outer member 210; consequently, the outer member 210 is spaced from the inner member 220 to define a substantially annular gap or cavity therebetween. Finally, the cap portion 230 is further positioned over the inner member flange 295.

The cavity is capable of holding a fluid and/or objects. Preferably, the cavity includes elements or objects suspended in a fluid. As shown in the embodiment of FIG. 3, the cavity formed between the outer and inner members 210, 220 may include fluid 300 and/or decorative or educational objects 320. The fluid 300 may comprise, but is not limited to, fluid that is transparent, translucent, colored, and/or opaque. By way of specific example, the fluid 300 may include a transparent fluid such as water or glycerin. The decorative or educational objects 320 may include, but are not limited to, glitter, holographic particles, and objects relating to the alphabet, shapes, math, etc. By way of specific example, the decorative or educational objects 320 may include numbers, letters, geometric shapes, musical notes, etc. The decorative or educational objects 320 are preferably buoyant such that, when dispersed in the fluid 300, they are suspended therein. The decorative or educational objects 320 may further include an eccentric weight configured to consistently orient the decorative or educational object 320 in a desired orientation, e.g., to position the decorative or educational objects right-side-up when viewed through the inner member 220 or the outer member 210.

As shown in the embodiment of FIG. 3, the outer member 210 may further include a post 285 extending axially from the exterior surface 250 of the outer member 210 proximate the bottom of the container 200. A fitting 290 may be axially inserted over or integrally formed with the post 285. The fitting 290 may include a structure configured as an attachment point for a cam member (not shown—discussed in detail below). Specifically, the fitting 290 may include a generally annular structure including one or more fins 297 extending both radially and axially outward therefrom.

Figure 4:
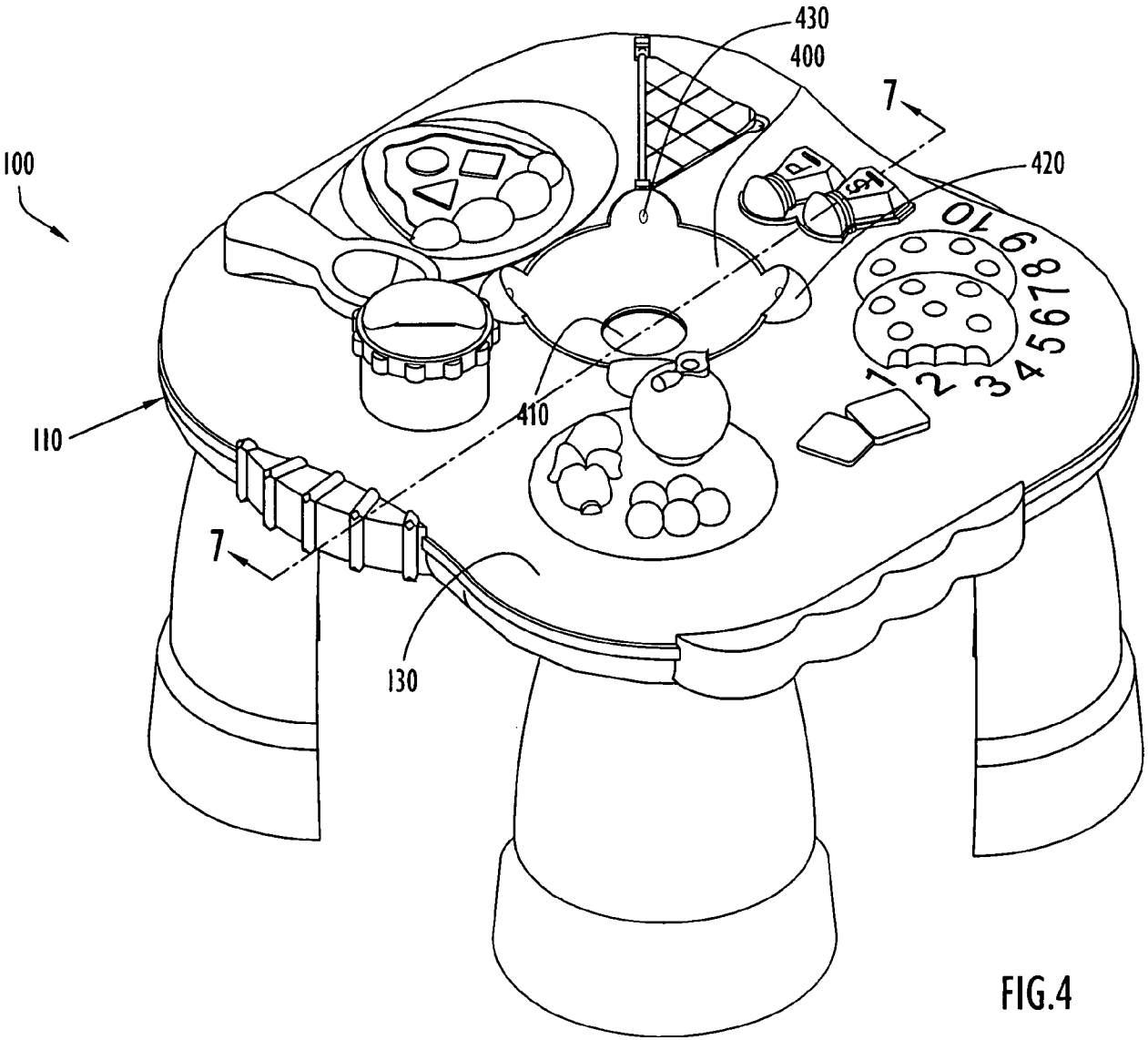
FIG. 4 illustrates a perspective view of the activity device of FIG. 1, wherein the rotatable container has been removed to reveal the housing of the activity device in greater detail.

FIG. 4 illustrates a perspective view of the activity device 100 of FIG. 1, wherein the container 200 has been removed to reveal the housing 110 of the activity device 100 in greater detail. In accordance with the invention, and as shown in FIG. 4, the upper section 130 of the housing 110 may include a socket or well 400. The size and shape of the well 400 is not limited to that which is illustrated in FIG. 4 and, as such, it may be of any appropriate size and shape without departing from the scope and spirit of the present invention. As shown in the embodiment of FIG. 4, the well 400 may include a generally curved complimentary depression configured to receive the container 200 which is, in the illustrated embodiment, stylized as a bowl (as shown in FIG. 1). The bottom of the well 400 may further include an aperture 410 configured to align with the post 285 and the fitting 290 of the container 200 (as shown in FIG. 3) and permit their passage therethrough. The top periphery of the well 400 may include one or more buttresses 420 extending upward from the surface of the upper section 130 of the housing 110. Each buttress 420 may be configured to not only support the container 200 within the well 400, but also to house a light source 430. The light source 430 may include, but is not limited to, colored and/or white light emitting diodes (LEDs). In operation, the buttresses 420 may be adapted to direct the light sources 430 toward the container 200, illuminating the container 200, the fluid 300 and decorative or educational objects 320 held within the cavity of the container 200, or both.

Figure 5:
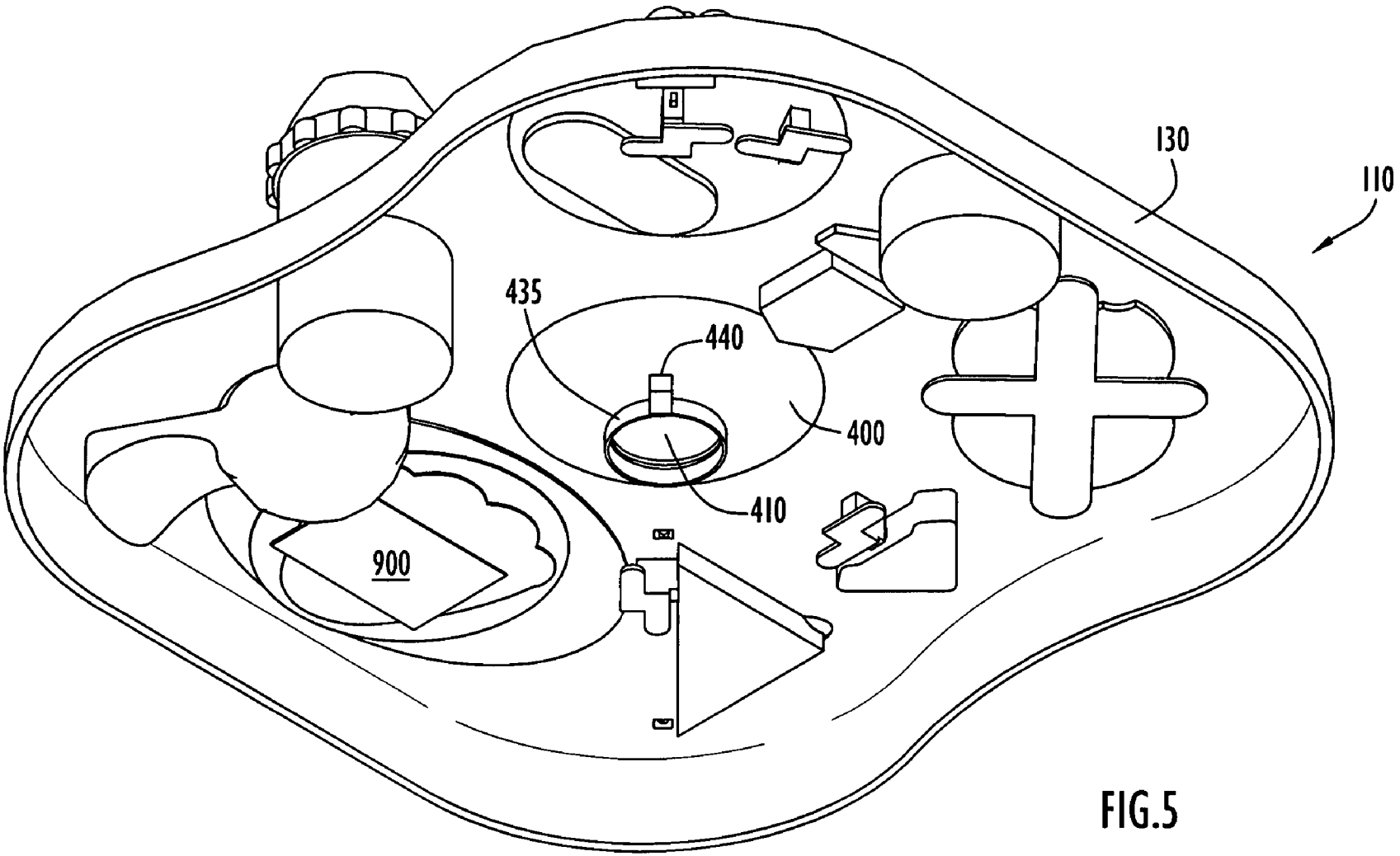
FIG. 5 illustrates a bottom perspective view of the interior of the housing upper section of the activity device of FIG. 1.

FIG. 5 illustrates a bottom perspective view of the interior of the housing upper section 130 of the housing 110 of the activity device 100 of FIG. 1. In the embodiment of FIG. 5, the well 400 is shown extending downward from the interior surface of the housing upper section 130, with the aperture 410 centrally positioned at the bottom of the well 400. Extending from the periphery of the aperture 410 is a wall or lip portion 435. An actuator 440 is also positioned along the periphery of the well aperture 410 and configured to contact a cam member (not shown—discussed in detail below). FIG. 5 further illustrates the various interactive features of the activity device (shown in FIG. 1) and their coupling to a control unit 900 located within the housing 110. The interactive features may be coupled to the control unit 900 using, for example, wired or wireless connections (neither of which, for the purposes of clarity and brevity, is illustrated).

Figure 6A:
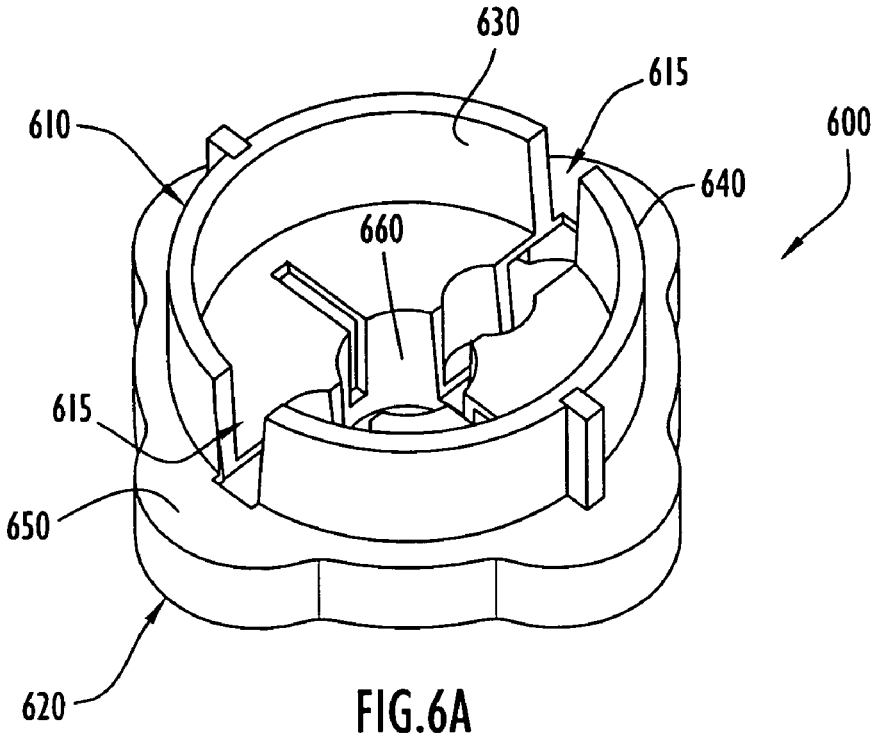
FIGS. 6A and 6B illustrate isolated perspective views of the cam member associated with the rotatable container of the activity device of FIG. 1.
Figure 6B:
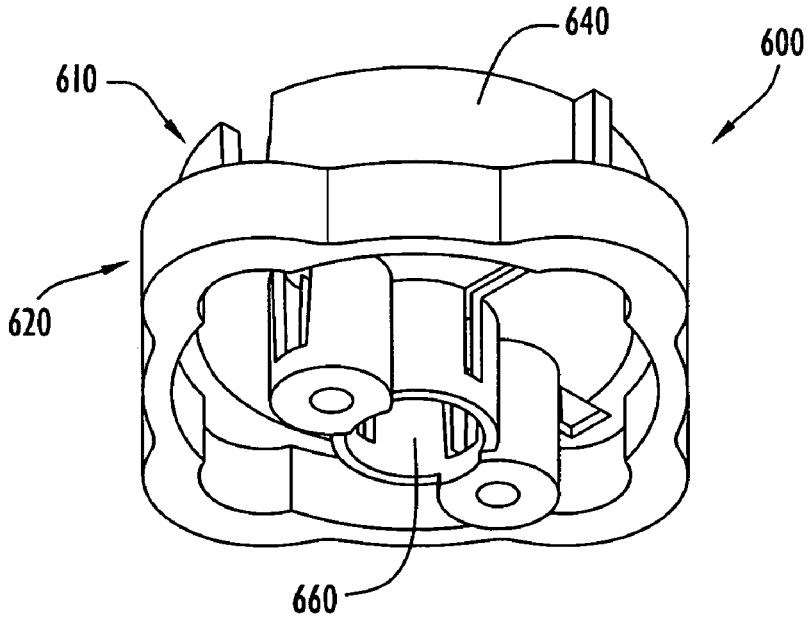

FIGS. 6A and 6B disclose a cam member 600 associated with the rotatable container 200 of the activity device 100 of FIG. 1 according to an embodiment of the invention. The cam member 600 may include a structure adapted to capture the container 200 within the well 400 of the housing 110 while permitting the free rotation of the container 200 about its axis. As shown in FIG. 6A, the cam member 600 includes an upper portion 610 and a lower portion 620. The outer surface of the upper portion 610 may be configured to slidingly engage the inner surface of the lip 435 that extends downward from the well aperture 410 (shown in FIG. 5). The upper portion 610 also serves to frictionally engage the container fitting 290 of the container 200. In the embodiment of FIGS. 6A and 6B, the upper portion 610 includes a generally annular wall interrupted by two cut-away sections 615 situated approximately 180° apart. The cut-away sections 615 may be configured to engage the fins 297 of the container fitting 290 (shown in FIG. 3). The upper portion 610 further includes an inner surface 630 and an outer surface 640. The diameter of the upper portion 610 may be configured such that outer surface 640 of the upper portion 610 slidingly engages the inner surface of the lip 435 that extends downward from the well aperture 410. Furthermore, the inner surface 630 of the upper portion 610 is adapted to abut the outer surface of the fitting 290 of the container 200.

The lower portion 620 of the cam member 600 (best seen in FIG. 6B) includes a diameter larger than that of the lip 435 (which extends downward from the well aperture 410), and forms a ledge 650 extending radially beyond the upper portion 610. The ledge 650 may serve as a stop, preventing the insertion of the cam member 600 beyond the lip 435. In addition, the ledge 650 may be configured to intermittently engage the actuator 440 positioned along the lip 435 of well aperture 410 (as illustrated in FIG. 5). Specifically, the ledge 650 may include an undulating surface having a series of protrusions and valleys sized to selectively engage and disengage the actuator 440 as the cam member 600 rotates about its axis (as explained in detail below). An aperture 660 extends through the center of the lower portion 620. The aperture 660 is configured to slidingly engage the container post 285, permitting it to extend entirely through the cam member 600.

Figure 7:
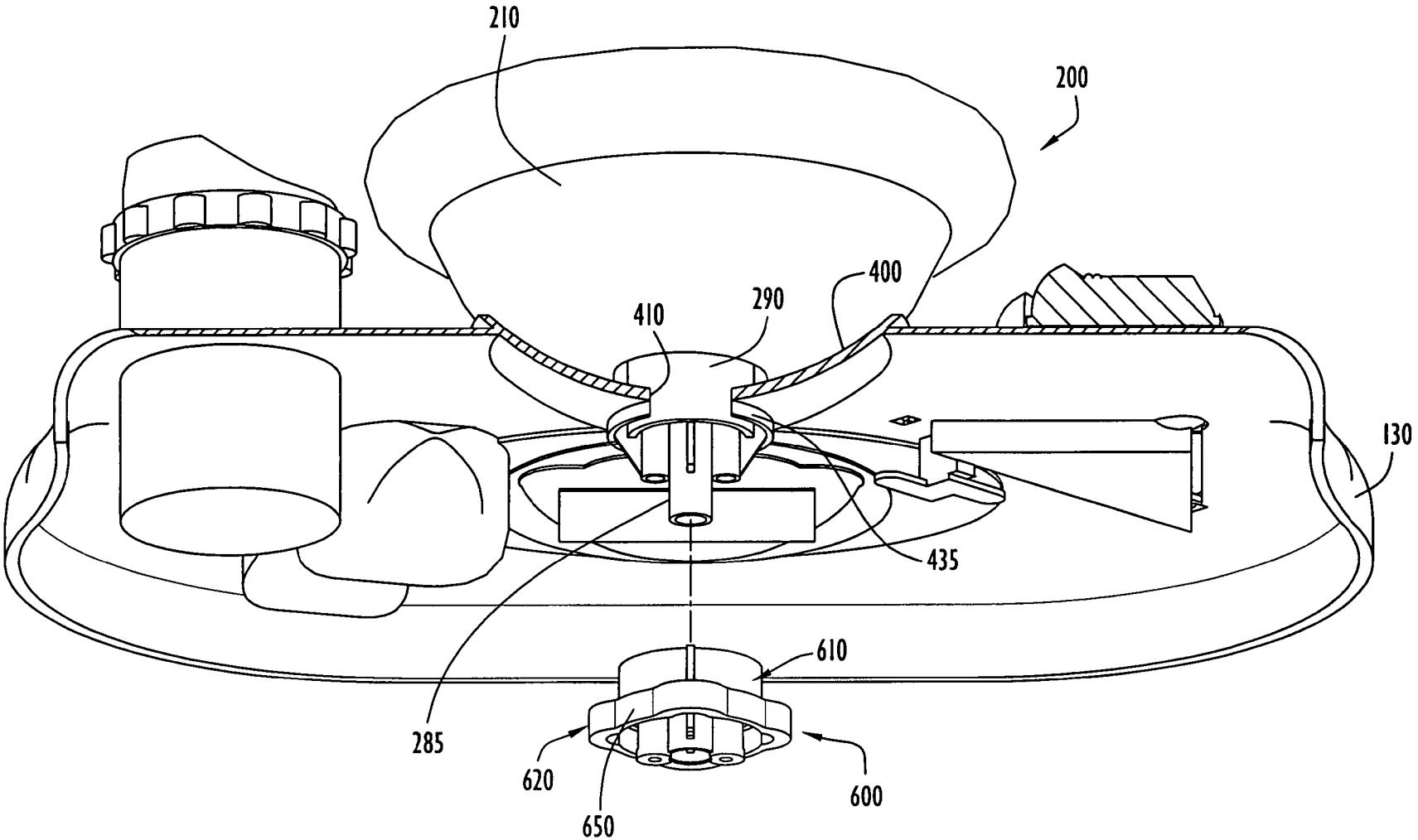
FIG. 7 illustrates an exploded, partial-cross-sectional bottom perspective view taken along line 7-7 of FIG. 4 of the interior of the housing upper section of the device of FIG. 1 with the rotatable container included, showing connection of the container to the upper section of the housing.

FIG. 7 illustrates an exploded, partial-cross-sectional bottom perspective view taken along line 7-7 of FIG. 4 of the interior of the housing upper section 130 of the activity device 100 of FIG. 1 with the rotatable container 200 included, showing the connection of the container 200 to the upper section of the housing 130. More specifically, FIG. 7 shows an exploded view of the container 200, the well 400 of the upper section of the housing 130, the container post 285, the container fitting 290, and the cam member 600. As shown in the embodiment of FIG. 7, the container 200 is positioned within the well 400 of the upper section of the housing 130 such that the container post 285 and the container fitting 290 extend through the aperture 410 and into the upper section 130 of the housing 110. The cam member 600 is placed on the container post 285, with the container post 285 axially inserted into the aperture 660 of the cam member 600. The upper portion 610 of the cam member 600 is inserted axially until it contacts the outer member 210 of the container 200 and is positioned between the lip 435 surrounding the well aperture 410 and the container fitting 290. Thus, the container fitting 290 is completely inserted into the upper portion 610 of the cam member 600, with the container post 285 extending into the aperture 660 of the cam member 600. The ledge 650 of the lower portion 620 abuts the lip 435 surrounding the well aperture 410. The ledge 650, moreover, aligns with the actuator 440 (not shown in FIG. 7, but best seen in FIG. 5). Thus, when the cam member 600 is attached to the container fitting 290 (using conventional securing means such as screws, adhesives, thermal welding, chemical welding, etc.), the lip 435 surrounding the well aperture 410 is trapped therebetween, which prevents the separation of the container 200 from the well 400 of the upper section of the housing 130. The container 200 is then rotatably secured within the well 400 of the upper section 130 of the housing 110.

Figure 8A:
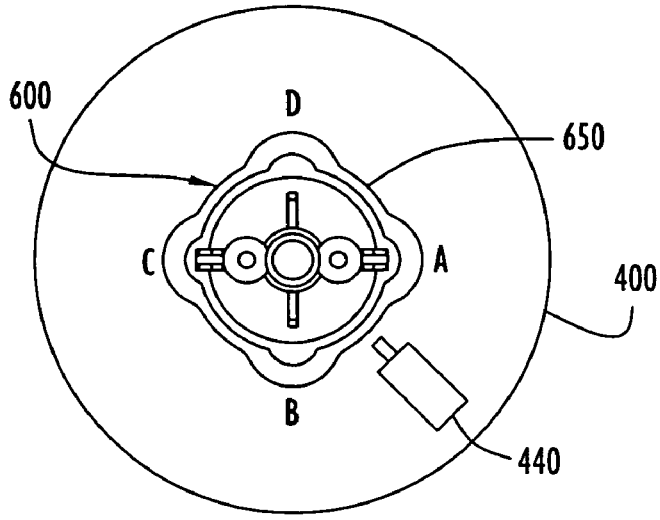
FIGS. 8A-C illustrate a bottom plan view of an isolated portion of the interior of the housing upper section of the device of FIG. 1, showing the engagement of an actuator as the container is rotated.
Figure 8B:
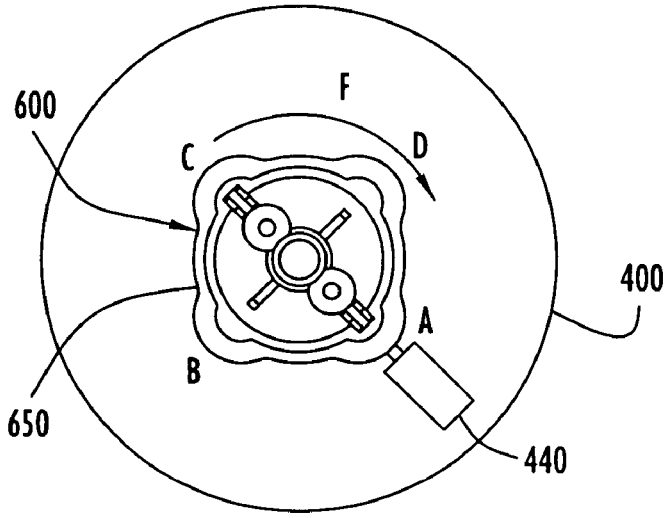
Figure 8C:
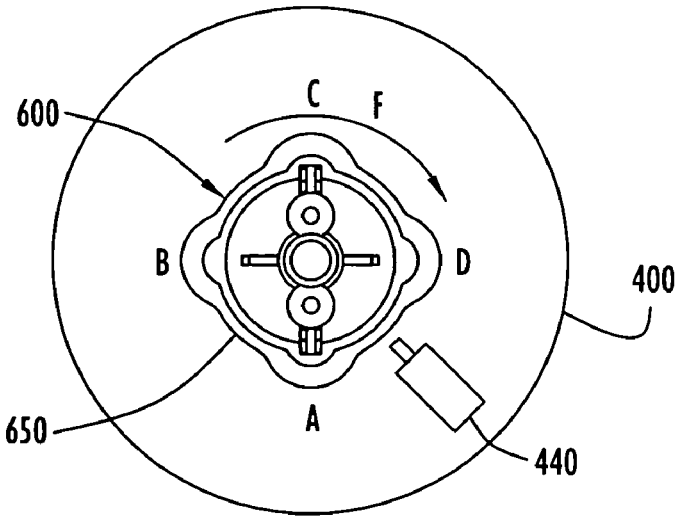

FIGS. 8A-C illustrate a bottom plan view of an isolated portion of the interior of the housing upper section of the device of FIG. 1, showing the engagement of an actuator as the container is rotated. More specifically, FIGS. 8A-8C illustrate a plan bottom view of the well 400 of FIG. 5 (with the container 200 now rotatably secured within the well 400 of the upper section 130 of the housing 110 by the cam member 600), showing the mechanism adapted to engage the actuator 440 according to an embodiment of the invention. The container 200 of the activity device 100 begins in an initial, stationary position (as illustrated in FIG. 8A). The undulating surface of the ledge 650 of the cam member 600 includes a first protrusion A, a second protrusion B, a third protrusion C, and a fourth protrusion D. The cam member 600 is positioned such that the actuator or switch 440 is located in the "valley" between the first protrusion A and the second protrusion B. As shown in FIG. 8B, a force (indicated by arrow F) is then applied to the container 200, e.g., by manually rotating the container 200. Force F causes the container 200 to rotate, which, in turn rotates the container post 285 and the container fitting 290 (shown in FIG. 3). As explained above, the cam member 600 is fixedly attached to the container fitting 290 and, consequently, the rotation of the container fitting 290 also rotates the cam member 600.

Referring to FIG. 8B, as the cam member 600 rotates along a substantially circular (360°) travel path, the first protrusion A contacts the actuator 440, closing the circuit. The actuator 440 sends a signal to the control unit 900 (shown in FIG. 5), which identifies the actuator 440 and generates a switch-specific sensory output (e.g., lights and/or sound).

Referring now to FIG. 8C, as the container 200 continues its rotational path in direction of force F, the actuator 440 is positioned within the valley located between the first protrusion A and the fourth protrusion D. The actuator 440 is no longer engaged/depressed, and the circuit is opened (i.e., no signal is sent to the control unit). As force F is again applied and the cam member 600 continues along its rotational travel path, the protrusions A, D, C, B continue to intermittently engage the actuator 440, causing the control unit to generate switch-specific sensory output.

Figure 9:
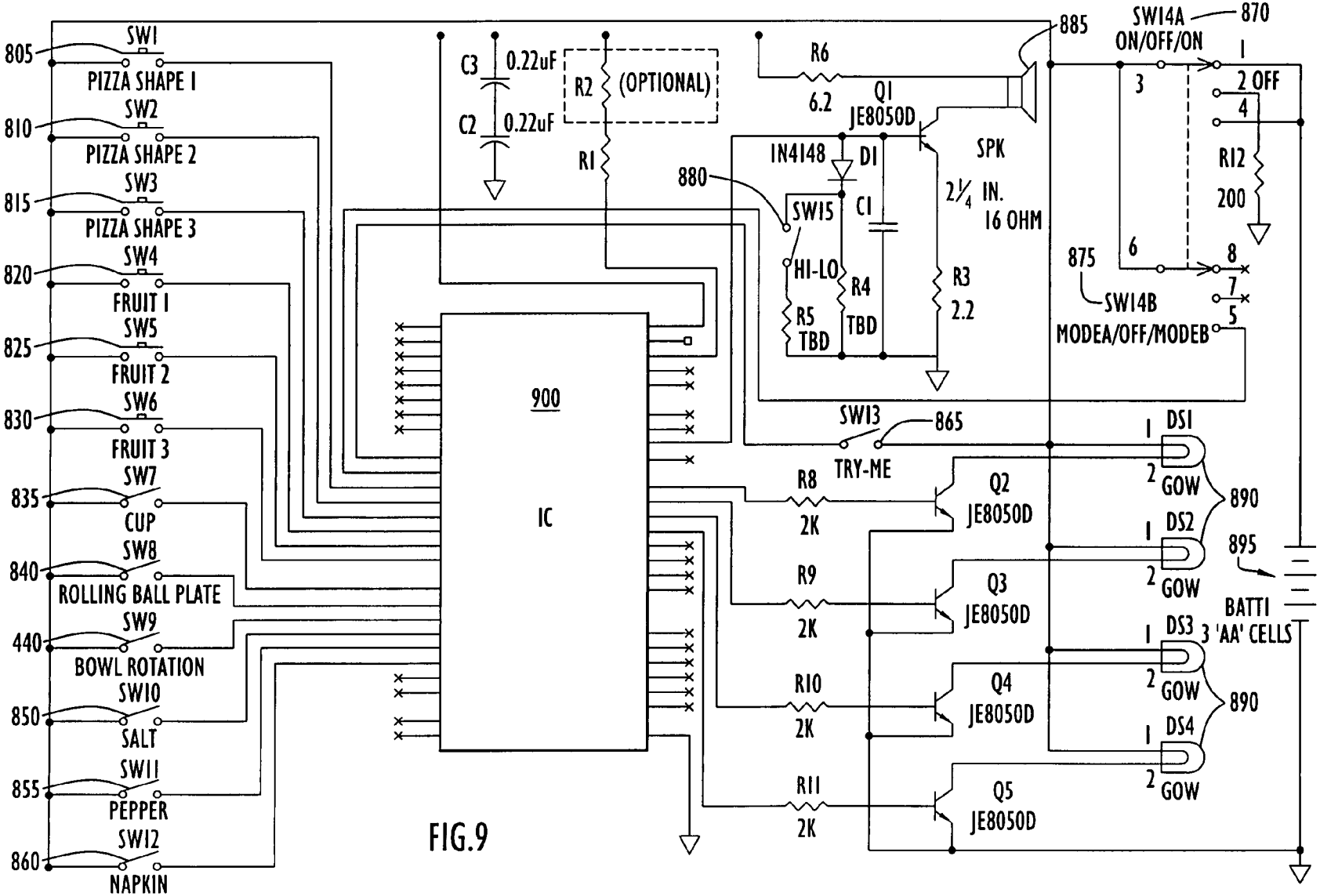
FIG. 9 illustrates an electronic schematic for the device of FIG. 1 according to an embodiment of the present invention.

FIG. 9 illustrates an electronic schematic for the activity device 100 of FIG. 1 according to an embodiment of the present invention. As shown, the schematic includes an control unit having one or more switches or actuators that correspond to the various interactive features of the activity device 100. Each switch may comprise, but is not limited to, a mechanical switch (pressure sensitive, contact, push, pivot, and slide), an electrical switch, a magnetic switch, an optical switch, etc. The number of switches, moreover, is not limited. By way of example, as shown in FIG. 9, the activity device includes 16 separate switches, each switch being associated with a particular interactive feature.

For instance, a first switch 805 (SW1) may be utilized to indicate the first pizza button/actuator (e.g., the square-shaped button, 160C in FIG. 1) has been actuated. Similarly, a second switch 810 (SW2—the circular button on pizza feature, 160A in FIG. 1) and a third switch 815 (SW3—the triangular button on pizza feature, 160B in FIG. 1) may be used to indicate whether the second and third pizza buttons, respectively, have been actuated. A fourth switch 820 (SW4), a fifth switch 825 (SW5), and a sixth switch 830 (SW6) can be used to indicate when the three elements of the fruit plate feature (indicated as 175 in FIG. 1) have been actuated (e.g., whether the banana button 175C has been depressed, whether the apple 175A has been rotated on its axis, or whether the berry cluster 175B has been slid). A seventh switch 835 (SW7) may indicate whether the sippy cup (indicated as 170 in FIG. 1) has been engaged (pushed downward to actuate the seventh switch 835). An eighth switch 840 (SW8) may indicate whether the cookie feature (indicated as 180 in FIG. 1) has been depressed. A ninth switch 440 (SW9) may be associated with the rotatable container to, as described in detail above, indicate whether or not the container (indicated as 200 in FIG. 1) has been rotated a predetermined angular distance. A tenth switch 850 (SW10) and an eleventh switch 855 (SW11) may be used to indicate the salt and pepper shaker feature (indicated as 185 in FIG. 1) has been actuated (tilted in the direction of the salt (SW10) or in the direction of the pepper (SW11)). A twelfth switch 860 (SW12) may indicate when the napkin feature (indicated as 190 in FIG. 1) has been actuated (i.e., when it is pivoted to its open position).

Other switches may actuate other features of the electronics unit. For example, a thirteenth switch 865 (SW 13) can temporarily supply power to the device and play a predetermined output pattern (for a "Try-Me" feature). The fourteenth switch, comprising secondary switches 870 (SW14A) and 875 (SW14B), can be used to provide power to the control unit of the activity device 100 (i.e., to turn the device on and to provide power to speaker, the LEDs, etc.) (SW14A), as well as to set the electronic mode of the control unit of the activity device 100 (e.g., music or learning) (SWl4B). Finally, a fifteenth switch 880 (SW15) can be used to adjust the volume of the speaker output (hi/lo).

As shown in FIG. 9, the activity device 100 includes various sensory output generating devices including, but not limited to, a speaker 885 and lights 890 (e.g., light emitting diodes (LEDs—DS1, DS2, DS3, and DS4)). The activity device 100 further includes a power source 895 (e.g., three "AA" batteries) and a control unit 900. Specifically, each of the switches 805, 810, 815, 820, 825, 830, 835, 840, 440, 850, 855, 860, 865, 870, 875, and 880, the speaker 885, the lights 890, and the power source 895 are operatively coupled (connected) to the control unit 900 which is capable of producing switch-specific sensory stimulating electronic output such as animation, light, and sound (verbal, music, sound effects, etc.) The type of control unit is not limited, and includes microcontrollers, microprocessors, and other integrated circuits. Control unit 900 recognizes and controls signals generated by the various switches 805, 810, 815, 820, 825, 830,

835, 840, 440, 850, 855, 860, 865, 870, 875, and 880, as well as generates and controls operational output directed through various sensory generating devices (the speaker 885, the lights 890). The control unit 900 continually monitors the electronic status of the various switches, generating and altering the sensory output (e.g., sounds and/or lights) accordingly.

In operation, setting fourteenth switch 870, 875 to the desired electronic mode may supply power to the activity device 100. The types of electronic modes may comprise, but are not limited to an "ABC" (or a learning) mode and a music mode. The learning mode may generate sensory stimulating output generally relating to counting, letters, spelling, shapes, and phonetics, on a random basis or according to a predetermined script. The output, moreover, may be cyclical and generally relate to a specific characteristic of the actuated switch. For example, when the first switch 805 (SW 1) (the square-shaped button, 160C in FIG. 1) is actuated, the control unit 900 may generate a first phrase (e.g., "square,"), as well as a first musical riff or song to be output via the speaker 885. When the first switch 805 is actuated a second time, the control unit 900 may generate a second output (e.g., "green square") and a second musical riff or song to be output via the speaker 885. The third time first switch 805 is actuated; the control unit 900 may generate a third phrase (e.g., "MMM pizza") and a third musical riff or song to be output via the speaker 885. Similarly, when the second switch 810 (SW2) (the circular button 160A on the pizza feature 160) and/or third switch 815 (SW3) (the triangular button 160B on the pizza feature 160) are actuated, the control unit 900 may cyclically generate one of three phrases, and/or an assortment of music riffs, as well as a song to be output via the speaker 885.

The control unit 900 generates output for the remaining switch actuations in a like manner. By way of example, each time any one of the fourth switch 820 (SW4), the fifth switch 825 (SW5), and the sixth switch 830 (SW6) are actuated (the elements 175A-C of the fruit plate feature 175), the control unit 900 may cyclically generate a phrase followed by a sound effect (e.g., "apple" and a "crunch" sound effect), based upon the predetermined script. Similarly, when the seventh switch 835 is actuated (via up or down movement of the sippy cup feature 170), the control unit 900 may cyclically generate one of eight sounds (e.g., phrases such as "empty" or "full" and sound effects such as "glug glug"), to be output via the speaker 885 in order of a predetermined script. Similar cyclical output including music (1-10 songs and musical riffs), sound effects (e.g., a whistle sound), and verbal statements (e.g., "it's learning time") can produced by the speaker 885 and controlled by the control unit 900 for the remaining switches.

The music electronic mode may generate sensory stimulating output generally relating to music and including sound effects. For example, when the first switch 805 (SW1) (the square button 160C of the pizza feature 160) is actuated, the control unit 900 may generate a C-chord riff. Similarly, when the second switch 810 (SW2) and third switch 815 (SW3) are engaged (the circle button 160A and the triangle button 160B of the pizza feature 160, respectively), the control unit 900 may generate an E-chord riff and a G-chord riff, respectively. When the fourth switch 820 (SW4), the fifth switch 825 (SW5), and the sixth switch 830 (SW6) are engaged (the elements 175A-C of the fruit plate feature 175), the control unit 900 may cyclically generate one of three sound effects followed by one of six song melodies (e.g., one sound effect and two songs for each switch), played in order of a predetermined script. When the ninth switch 440 (SW9) is actauted (by rotating the container 200), the control unit 900 may generate one of five phrases or songs, played in order of the predetermined script. As with the learning mode, similar cyclical output including music (e.g., songs such as "La Cucaracha" or "Pop Goes the Weasel", as well as musical riffs such as percussion riffs) and sound effects (e.g., twinkles, shimmer, and slide up/slide down) can be generated for the remaining switches.

Additionally, the control unit 900 may control other sensory stimulating output such as lights. As noted above, electronics assembly includes LEDs 890 that illuminate the container 200 and any fluid 300 or objects 320 held within the container cavity. The control unit 900 controls the activation and pattern of this light output. The light display pattern is not limited, and includes various sequences. By way of example, the patterns include (1) a clockwise circle pattern with individual lights flashing on and off in sync to music or speech being output via the speaker 885; (2) a pattern in which opposite lights flash together in sync to music or speech being output via the speaker 885; (3) a pattern in which all four lights flash on and off at the same time in sync to music or speech being output via the speaker 885; (4) a pattern in which two lights positioned cattycorner flash at a time and follow a clockwise pattern in sync to music or speech being output via the speaker 885; and (5) two lights positioned on one side (e.g., the right side) flash on and off together, then the two lights on the opposite side flash, all in sync to music or speech being output via the speaker 885. The light patterns may play for all or part of the sound output duration.

While the invention has been described in detail and with reference to specific embodiments thereof, it will be apparent to one skilled in the art that various changes and modifications can be made therein without departing from the spirit and scope thereof. For example, it is to be understood that terms such as "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration. Furthermore activity device 100 need not by stylized as a table top, and may be stylized as other structures including furniture, vehicles, animals, humanoid figures, and geometric shapes. Similarly, the container 200 may be of any size and shape capable of storing an accessory, including but not limited to geometric shapes such as blocks. The sensory output generating devices may produce lights and/or sound, including music, speech and sound effects. The output pattern is not limited and includes any pattern of music, lights, and/or sound effects. The electronics assembly may include additional switches to provide additional electronic sensory output actuation. Thus, it is intended that the present invention covers the modifications and variations of this invention that come within the scope of the appended claims and their equivalents.

We claim:

1. An activity device comprising:

a housing including a control unit adapted to generate a sensory output;

an open container rotatably mounted on the housing, operable to selectively receive at least one accessory while coupled to the housing; and at least one actuator coupled to the control unit, wherein rotation of the container engages the actuator and activates the control unit to generate the sensory output.

2. The activity device of claim 1, wherein the container includes an accessory supporting surface and an opening through which an accessory may be placed onto and removed from the accessory supporting surface by a user.

3. The activity device of claim 1, wherein the container includes an inner wall and an outer wall with a cavity defined therebetween, and wherein at least one of the inner and outer walls is transparent.

4. The activity device of claim 3, wherein the container includes a liquid medium disposed in the cavity.

5. The activity device of claim 4, wherein the liquid medium includes objects dispersed therein.

6. The activity device of claim 1, wherein the container comprises a bowl including a curved base, an inner wall, an outer wall, and a cavity disposed between the inner and outer walls, and wherein at least one of the inner and outer walls is transparent.

7. The activity device of claim 6, wherein the container includes a liquid medium disposed in the cavity.

8. The activity device of claim 7, wherein the liquid medium includes objects dispersed therein.

9. The activity device of claim 1, wherein the sensory output generated by the control unit is an audible output.

10. The activity device of claim 1, wherein the sensory output generated by the control unit is a visual output.

11. The activity device of claim 1, wherein the housing is positioned above a supporting surface.

12. The activity device of claim 11, wherein the housing is positioned above a supporting surface by at least one leg.

13. The activity device of claim 1, wherein the housing includes a light source adapted to illuminate the container.

14. The activity device of claim 4, wherein the housing includes a light source adapted to illuminate the liquid medium disposed in the cavity.

15. An activity device comprising:

a housing;

an open container mounted on the housing, the container being operable to selectively receive at least one accessory while coupled to the housing and the container adapted to rotate freely about an axis on the housing, the container including an outer wall, an inner wall, and a liquid medium disposed in a cavity located between the inner and outer walls, at least one of the inner and outer walls being transparent, wherein rotation of the container about the axis causes agitation of the liquid medium; and a control unit adapted to generate sensory stimulating output upon rotation of the container by a user of the activity device.

16. The activity device of claim 15, further including an actuator coupled to the control unit.

17. The activity device of claim of 16, wherein rotation of the container engages the actuator and activates the control unit to generate sensory stimulating output.

18. The activity device of claim 15, wherein the container includes an interior surface and an opening though which the at least one accessory may be placed onto and removed from the interior surface.

19. The activity device of claim 15, wherein the liquid medium includes objects dispersed therein.

20. The activity device of claim 15, wherein the container comprises a bowl including a curved base.

21. The activity device of claim 15, wherein the sensory stimulating output generated by the control unit is an audible output.

22. The activity device of claim 15, wherein the sensory stimulating output generated by the control unit is a visual output.

23. The activity device of claim 15, wherein the housing is positioned above a supporting surface.

24. The activity device of claim 23, wherein the housing is positioned above a supporting surface by at least one leg.

25. The activity device of claim 15, wherein the housing includes a light source adapted to illuminate the container.

26. The activity device of claim 25, wherein the light source is adapted to illuminate the liquid medium disposed within the cavity.

27. The activity device of claim 1, wherein the container comprises:

an accessory supporting surface; and a sidewall extending upward from the accessory supporting surface, wherein the sidewall defines an opening through which the container may receive the accessory.

28. The activity device of claim 27, wherein:

the actuator is disposed within the housing; and the container further includes at least one engagement member configured to selectively engage the actuator as the container is rotated on the housing.

29. The activity device of claim 27 further comprising a cam member coupled to the container and disposed within the housing, wherein the cam member includes at least one protrusion operable to engage the actuator as the container is rotated on the housing.

30. The activity device of claim 29, wherein the cam member comprises an undulating surface with at least one protrusion operable to the engage the actuator.

31. The activity device of claim 1, wherein the housing is in the form of a table top.

32. The activity device of claim 31, wherein:

the container comprises a bowl-shaped structure; and the housing includes a recess that receives the container.

33. The activity device of claim 1 further including an interactive feature disposed on the housing, wherein the interactive feature is operatively coupled to a switch in communication with the control unit.

34. The activity device of claim 33, wherein the control unit generates electronic sensory output.

35. The activity device of claim 15, wherein the container further comprises:

an accessory supporting platform, a side wall surrounding the accessory supporting platform portion and extending upwardly therefrom, and an opening defined by the sidewall, the opening permitting the selective placement and removal of an accessory onto and off of the accessory supporting platform while the container is mounted to the housing; and the housing comprises a socket configured to receive the container.

36. The activity device of claim 35, wherein the container comprises a bowl-shaped structure.

37. The activity device of claim 15, wherein the housing comprises a table top and the container comprises a bowl extending upward from a surface of the tabletop.

38. The activity device of claim 15 further comprising an interactive feature disposed on the housing, wherein the interactive feature is operatively coupled to a switch in communication with the control unit.

39. The activity device of claim 15, wherein the container is capable of rotation in a first direction and a second direction; and the control unit adapted to generate sensory stimulating output upon rotation of the container in both the first and second directions.

40. An activity device comprising:

a housing including a control unit adapted to generate sensory output, and a container rotatably mounted to the housing and including:

an upwardly extending sidewall defining an opening;

an accessory supporting platform accessible through the opening, the opening permitting the selective placement and removal of an accessory onto and off of the accessory supporting platform while the container is coupled to the housing; and at least one actuator, wherein rotation of the container a predetermined distance with respect to the housing causes the at least one actuator to activate the control unit to generate the sensory output.

41. The activity device of claim 40, wherein the container further includes an inner wall and an outer wall with a cavity defined therebetween, and wherein at least one of the inner and outer walls are transparent.

42. The activity device of claim 41, wherein the container includes a liquid medium disposed in the cavity.

43. The activity device of claim 42, wherein the liquid medium includes objects dispersed therein.

44. The activity device of claim 40, wherein the housing is in the form of a table top.

45. The activity device of claim 40, wherein the container comprises a bowl-shaped structure.

46. The activity device of claim 40, wherein the sensory output generated by the control unit is at least one of an audible output and a visual output.

47. The activity device of claim 40, wherein the at least one actuator comprises a cam member including at least one protrusion capable of activating the control unit to generate the sensory output.

48. The activity device of claim 40, wherein the container is capable of rotation in a first direction and a second direction.

* * * * *

UNITED STATES PATENT AND TRADEMARK OFFICE

CERTIFICATE OF CORRECTION

PATENT NO. : 7,578,720 B2
APPLICATION NO. : 10/976305
DATED : August 25, 2009
INVENTOR(S) : Drosendahl et al.

It is certified that error appears in the above-identified patent and that said Letters Patent is hereby corrected as shown below:

Column 11, line 54, replace "though" with --through--.

Signed and Sealed this

Tenth Day of November, 2009

David J. Kappos

David J. Kappos
*Director of the United States Patent and Trademark Office*